United States Patent [19]

Anstett

[11] Patent Number: 4,621,758

[45] Date of Patent: Nov. 11, 1986

[54] NAILING MACHINE

[76] Inventor: Edgar P. Anstett, 21 Lakewood Pl., Highland Park, Ill. 60035

[21] Appl. No.: 775,783

[22] Filed: Sep. 13, 1985

[51] Int. Cl.[4] ..... B25C 5/06; B25C 5/11

[52] U.S. Cl. ..... 227/147; 227/109

[58] Field of Search ..... 227/109, 108, 116, 120, 227/147, 139

[56] References Cited

U.S. PATENT DOCUMENTS

| | | | |
|---|---|---|---|
| 1,655,275 | 1/1928 | La Place | 227/139 X |
| 2,423,821 | 7/1947 | Anstett | 227/139 X |
| 3,720,364 | 3/1973 | Maestri | 227/109 |
| 4,380,312 | 4/1983 | Landrus | 227/139 X |
| 4,463,888 | 8/1984 | Geist et al. | 227/109 |
| 4,470,531 | 9/1984 | Anstett | 227/139 X |

*Primary Examiner*—Paul A. Bell

*Attorney, Agent, or Firm*—Wallenstein, Wagner, Hattis, Strampel & Aubel, Ltd.

[57] ABSTRACT

A manually operated nailing machine having nail guide and positioning means for positively and unerringly maintaining a nail to be driven into a workpiece in proper alignment with the nail driving means of the machine and a workpiece. The nail guide and positioning means is interchangeable enabling the machine to be used with nails of different lengths.

10 Claims, 47 Drawing Figures

NAILING MACHINE

FIELD OF THE INVENTION

The present invention relates to a nailing machine, and, in particular, to a manually operated nailing machine capable of being used with nails of different lengths, the nails being in the form of an elongated strip with the heads thereof being severably interconnected.

BACKGROUND OF THE PRIOR ART

Manually operated nailing machines heretofore have been limited to use with nails of one size, the size of the nail being determined by the length of the double shanks of the nails which can vary from one inch to an inch and a quarter to an inch and a half. The inability to use the machines with nails of different sizes, of course, places restrictions on the type of work which can be performed by the machine. Thus, for example, a machine limited to use with one and a quarter inch nails for securing roofing shingles in place could not be used with one inch nails for use in laying down plywood flooring. A different machine would be needed. Yet another shortcoming of prior nailing machines of the type here under consideration centers on alignment of the nail to be driven into a workpiece and the workpiece itself. It is important that each nail, as it is severed by the driving blade of the machine, be aligned at substantially a right angle with the workpiece, otherwise the nail will not be completely embedded in the workpiece, or will be bent under the force of the driving blade, requiring another nail, and another blow from the resilient headed maul or mallet wielded by the operator. Conventional nailing machines rely upon the feed mechanism, namely, the pusher for the nailing strip, to position, and hold, the nails in alignment with the driving blade and the workpiece. In practice, such an arrangement is unsatisfactory, and does not meet the problem.

BRIEF DESCRIPTION OF THE INVENTION

In accordance with the present invention, a manually operated nailing machine has been evolved having unique versatility not only from the standpoint of its ability to accommodate nails of different length, but, also, from the standpoint of its ability to provide positive and unerring alignment of each nail in a nailing strip with the driving blade of the machine and a workpiece. In addition, the machine of the present invention is light in weight, and balanced in a manner to make it easy to manipulate. While, as stated, the nailing machine can be used with nails of different length, nails of about one inch, one and a quarter inches, and one and a half inches in length are the common sizes used in the trade. The nailing machine of the present invention is especially adapted to accommodate nails having these more common lengths. The nailing machine includes nail guide and positioning means which are interchangeable. The guide and positioning means advantageously comprises a stationary member and a movable member which in one position cooperate to provide an opening or gate for receiving a nail of a preselected length, and which in another position maintain the nail in proper alignment with the driving blade of the machine and a workpiece while a blow is delivered to the plunger of the machine by an operator. The guide and positioning means further advantageously includes nail feeder means for continuously urging the nails comprising a nailing strip into the opening or gate formed by the stationary and movable members of the nail guide and positioning means. The nail feeder means acts to keep uniform pressure on areas of a nailing strip which tends to prevent bending or distortion of the shanks of the nails, thereby cooperating with the stationary and movable members to maintain the nails in proper alignment as they are successively severed by the manually propelled driving blade. When it is desired to use nails of a different length, it is only necessary for the operator to remove the movable member of the nail guide and positioning means, and replace it with a movable member adapted for use with nails having the length required for a particular job. The removal and replacement of the movable member can be completed in a matter of seconds.

The foregoing and other advantages and features of the present invention will become more apparent from the description to follow, taken in conjunction with the accompanying drawings.

DETAILED DESCRIPTION OF THE INVENTION

Figures 1, 2, 3, 4, 5, 6, 7:
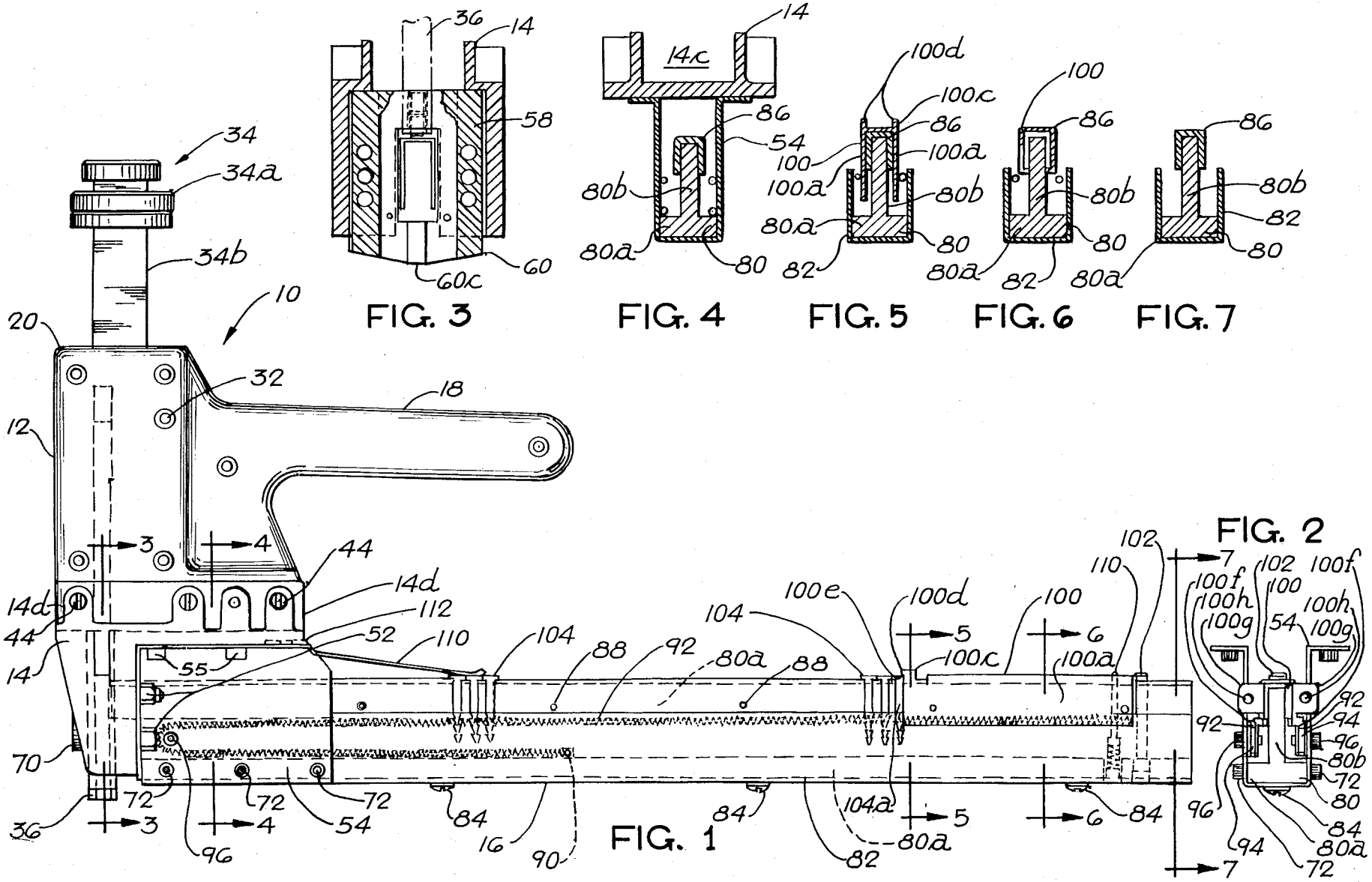
FIG. 1 is a side view in elevation of an embodiment of the nailing machine of the present invention.
FIG. 2 is an end view of the feeder mechanism of said embodiment of the invention.
FIG. 3 is a vertical sectional view taken substantially along line 3—3 of FIG. 1.
FIG. 4 is a vertical sectional view taken substantially along line 4—4 of FIG. 1.
FIG. 5 is a vertical sectional view taken substantially along line 5—5 of FIG. 1.
FIG. 6 is a vertical sectional view taken substantially along line 6—6 of FIG. 1.
FIG. 7 is a vertical sectional view taken substantially along line 7—7 of FIG. 1.

Referring, now, in greater detail to the drawings, the embodiment of the nailing machine illustrated in FIG. 1, and designated generally by reference numeral 10, comprises a body portion 12, a foot 14 for supporting nail guide and positioning means, and a nailing strip feeder mechanism 16. The body portion 12 advantageously comprises a pair of mating sections 12*a*—12*a* formed of a lightweight, high impact strength plastic material such as polyethylene or a polyacrylate. The sections 12*a*—12*a* desirably are molded to provide, when secured, together as by fastening means such as rivets 12*b*, an elongated handle 18 and a hollow, plunger receiving head 20. The hollow chamber 22 in the head 20 is provided with a pair of metal liners 24—24. The rear wall 24*a* formed by the liners 24—24 has a slot 26 formed therein through which a guide roller 28 extends. The roller 28 is positioned in a recess 30 provided in the head 20, and is journalled for rotation about a horizontal axis provided by a pin 32 extending through the head 20.

The head 20 has an opening 20*a* at the top for receiving a plunger 34, and an opening 20*b* at the bottom through which a nail driving blade 36 is driven when a blow is delivered to the plunger 34 by a resilient maul or mallet wielded by an operator. The plunger 34, as illustrated, has a cap 34*a* adapted to provide a surface of sufficient area to enable an operator to apply a forceful blow to the plunger with a maul or mallet. The plunger 34 also has an elongated, rectangularly shaped shaft 34*b*, the front wall of which is provided with a generally T-shaped recess 34*c* for receiving the correspondingly shaped upper end of the driving blade 36. The opposite, or rear, wall of the shaft 34 has a groove 34*d* formed therein in which the portion of the guide roller 28, extending through the slot 26 formed in the liners 24—24, is received. The ends of the groove 34*d* are curved outwardly, thereby limiting the extent of the upward movement of the shaft 34 in relation to the roller 28. A resilient rubber or plastic ring 35 advantageously is positioned on the shaft 34*b* of the plunger 34. The downward movement of the shaft 34, and perforce, the driving blade 36 is limited by the cap 34*a* and the ring 35 of the plunger 34. The shaft 34*b* of the plunger 34 further is provided with a vertical, elongated bore 34*e* for receiving a plunger pin 40 on which is positioned a compression spring 42. The pin 40 has a head 40*a* which abuts the lower wall 24*b* formed by the inturned edges of the liners 24—24. The front wall 24*c* formed by the liners 24—24 serves, in cooperation with the recess 34*c* formed in the shaft 34*b* of the plunger 34, to maintain the driving blade 36 in a fixed position on the plunger shaft 34*b* at all times. The driving blade 36, as shown, is formed with central, raised portions 36*a* and 36*b* on the front and rear sides, respectively, thereof, the function of which will become clear as the description proceeds.

The embodiment of the foot 14 of the nail machine 10, as best illustrated in FIGS. 18 through 21, has an upper, substantially horizontal leg 14*a* and a substantially vertical, downwardly extending leg 14*b*. The leg 14*a* has a channel 14*c* for receiving the base of the head 20 of the body portion 12. The sides of the leg 14*a* defining the channel 14*c* comprise a plurality of spaced, opposed bosses 14*d* provided with bores 14*e* for receiving fastening means such as bolts 44 for securing the foot 14 on the body portion 12. The leg 14*b* of the foot 14 has a recess 14*f* which receives nail guide and position means designated generally by reference numeral 50 in the drawings. The rear wall 14*g* of the leg 14*b* has a vertical slot 14*h* formed therein which serves as a gate for the sequential advancement of nails into the nail guide and positioning means 50. The upper end of the slot 14*h* has a centrally positioned extension 14*i* which has a tapped bore 14*j* for receiving a screw which serves to aid in securing the foot 14 to the body portion 12. The wall 14*g*, on each side of the slot 14*h* is provided with a plurality of vertically spaced bores 14*k* for receiving fastening means such as bolts 52 for securing the nail guide and positioning means 50 and a bracket 54, attached to the nailing strip feeder mechanism 16, to the foot 14.

Figure 42:
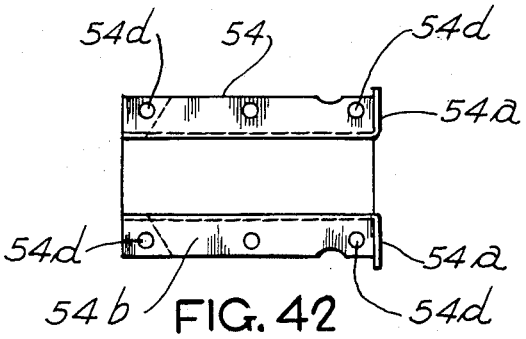
FIG. 42 is a top plan view of the bracket for securing the magazine or feeder mechanism to the foot of said embodiment of the machine.
Figure 43:
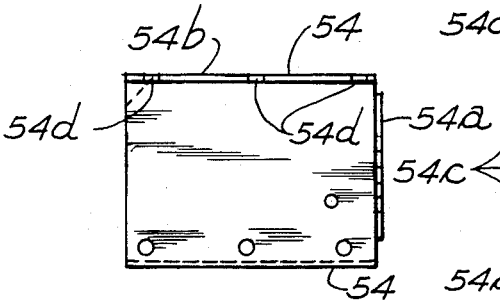
FIG. 43 is a side view in elevation of the bracket shown in FIG. 42.
Figure 44:
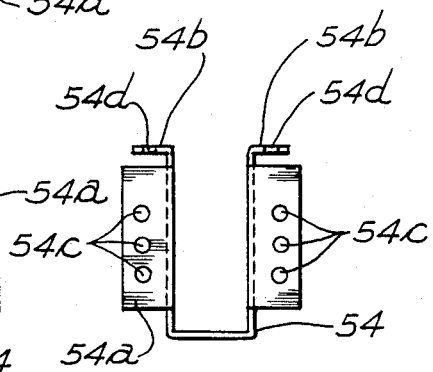
FIG. 44 is an end view of the bracket shown in FIGS. 42 and 43.
Figure 47:
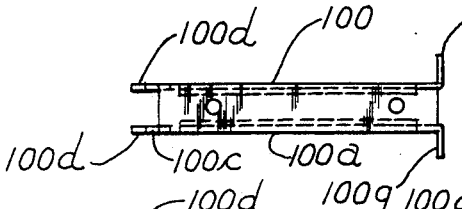
FIG. 47 is a top plan view of said embodiment of the feeder or pusher shown in FIGS. 45 and 46.
Figure 45:
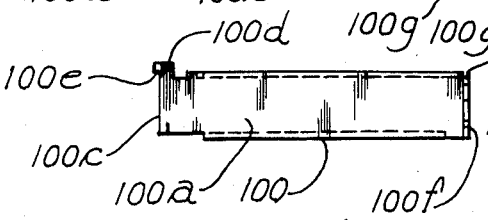
FIG. 45 is a side view in elevation of an embodiment of the nailing strip feeder or pusher of said embodiment of the nailing machine.
Figure 46:
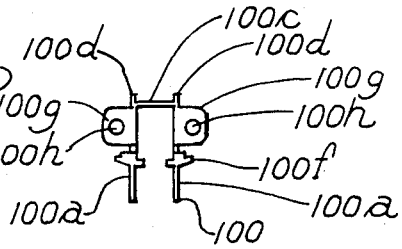
FIG. 46 is an end view of said embodiment of the nailing strip feeder or pusher shown in FIG. 45.

Referring to FIGS. 42–44 of the drawings, the embodiment of the bracket 54 illustrated is generally U-shaped in configuration, and is formed with a pair of ears or flanges 54*a*—54*a* along its front or leading edges and a pair of ears or flanges 54*b*—54*b* along its top edges. The flanges 54*a*—54*a* are provided with a plurality of vertically spaced holes 54*c* for receiving the bolts 52 which secure the nail guide 50 and the bracket 54 to the foot 14. The flanges 54*b*—54*b* are provided with a plurality of spaced, longitudinally extending holes 54*d* for receiving knurled-headed screws 55, for example, for securing the bracket 54 to the upper leg 14*a* of the foot 14 and to the base of the body portion 12.

Figures 8, 9, 10, 11, 12:
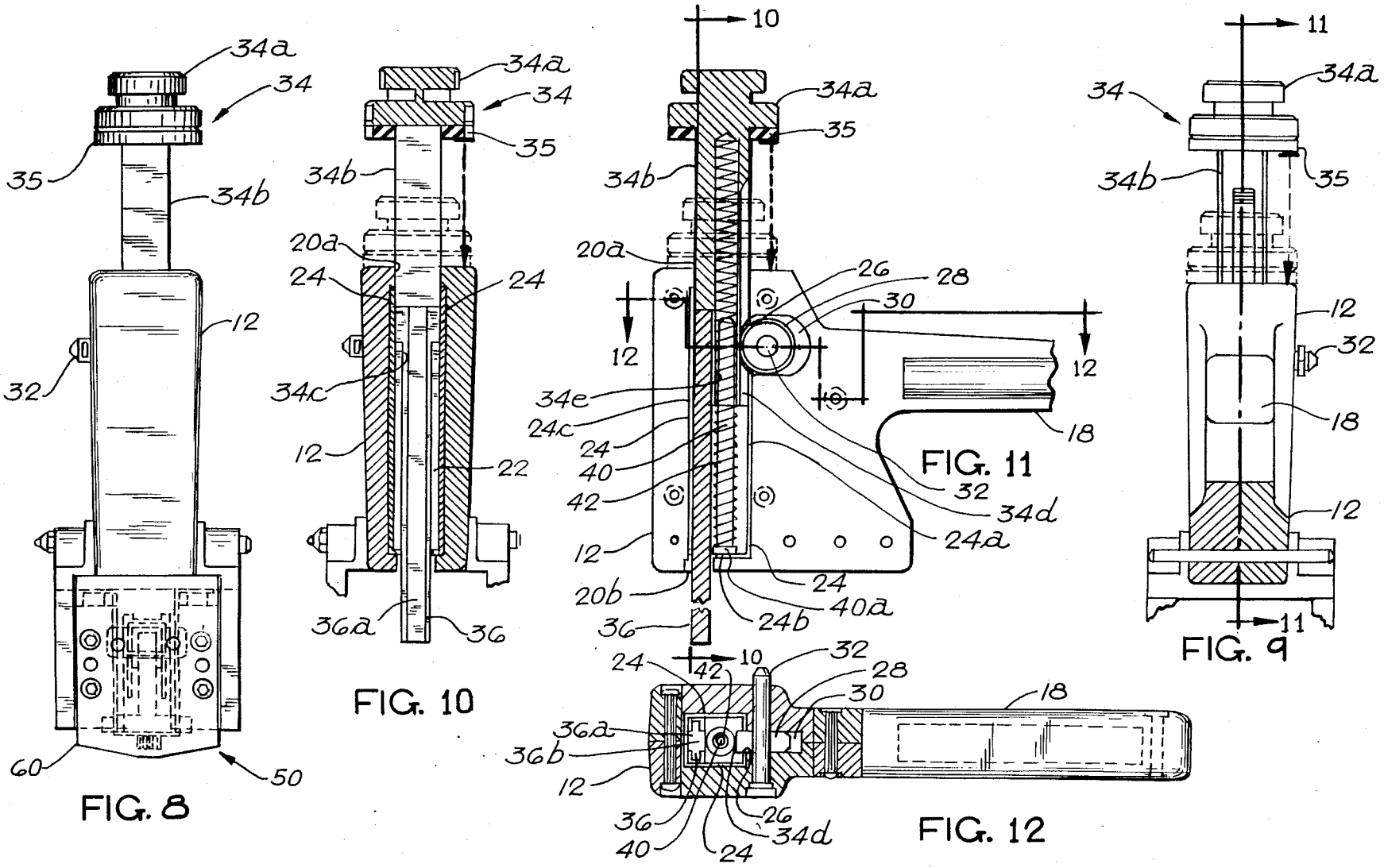
FIG. 8 is an end view in elevation of the head end of said embodiment of the invention.
FIG. 9 is an end view, partly in section, of the rear of the head end of said embodiment of the invention.
FIG. 10 is a vertical sectional view taken substantially along line 10—10 of FIG. 11.
FIG. 11 is a vertical sectional view taken substantially along line 11—11 of FIG. 9.
FIG. 12 is a vertical sectional view taken substantially along line 12—12 of FIG. 11.

The nail guide and positioning means 50, as illustrated in FIGS. 26 through 41, comprises an outer, stationary driving blade guide member 56, an inner stationary driving blade guide member 58, and an inner movable driving blade guide and nail positioning member 60. The member 56 is provided with a plurality of vertically spaced bores 56*a* which are in register with the bores 14*k* of the foot 14 for receiving the bolts 52. A longitudinally extending recess or channel 56*b* is formed in the inner wall of the member 56 for receiving the members 58 and 60. The channel 56*b*, in turn, is provided with a longitudinally extending, centrally positioned recess 56*c* in which the raised central portion 36*a* of the driving blade 36 is received. The member 58 desirably is secured to the member 56 at the upper end of the recess or channel 56*b* by fastening means such as rivets 62—62. The wall of the member 58 facing the channel 56*b* and the recess 56*c* of the member 56 also is provided with a channel 58*b* and a central recess 58*c*. The recess 58*c* receives the raised central portion 36*b* of the driving blade 36. The channel 58*b* and the recess 58*c*, together with the channel 56*b* and the recess 56*c* form a passageway for the driving blade 36 which conforms in cross-section to the cross-section of the driving blade 36 as best shown in FIG. 12, and which, in addition, conforms in configuration to the heads of the nails comprising the nailing strip carried on the feeder mechanism 16. The member 58 also is provided with a longitudinally extending slot 58*d* which is substantially the same width as the slot 14*h* of the foot 14.

The member 58 further is provided with a pair of vertical bores 58*e*—58*e* located on opposite sides of the channel 58*b*. The bores 58*e*—58*e* each received a pin 66. A compression spring 68 is supported on each of the pins 66 and acts to urge the lower end of the pins 66 against the movable member 60 of the means 50 thereby to maintain the member 60 in a normally downwardly extended position. The upper end of the springs 68 abut against the lower wall of the head 20 of the base portion 12.

The member 60 of the nail guide and positioning means 50 has a channel 60*b* and a central recess 60*c* which are substantially the same width as the channel 58*b* and the recess 58*c*, and constitute a continuation or extension of the passageway defined by the channel 58*b* and the recess 58*c* of the member 58. The member 60 is provided with a slot 60*d* having substantially the same width as the width of the slot 58*d* of the member 58 and the slot 14*h* of the foot 14. The slot 14*h*, together with the slots 58*d* and 60*d* provide a gate for nails as they are sequentially advanced by the feeder mechanism 16 of the machine 10. In order to assure positive positioning and alignment of a nail with the driving blade 36 and a workpiece prior to and during a nail severing and driving sequence, the upper ends 60*e*—60*e* of the channel 60*b* of the member 60 advantageously are chamfered or beveled. The chamfered or beveled ends 60*e*—60*e* enable the member 60 to unerringly intercept the pointed shanks of a nail fed through the gate formed by the slots 14*h*, 58*d* and 60*d*, and to guide the shanks of a nail along the channel 60*b* as the member 60 moves into engagement with the member 58, against the bias of the springs 68, when the member 60 is placed on the surface of a workpiece in a nailing position. The member 60, as shown, has a pair of slots 60*f*—60*f* formed therein on opposite sides of the channel 60*b*. The slots 60*f*—60*f* receive the ends of a pair of knurl-headed screws 70—70 which are threadly engaged in bores provided in the member 56. The slots 60*f*—60*f*, together with the screws 70—70 limited the longitudinal extent of the movement of the member 60 with relation to the member 58.

Figures 36, 37, 38, 39, 40, 41:
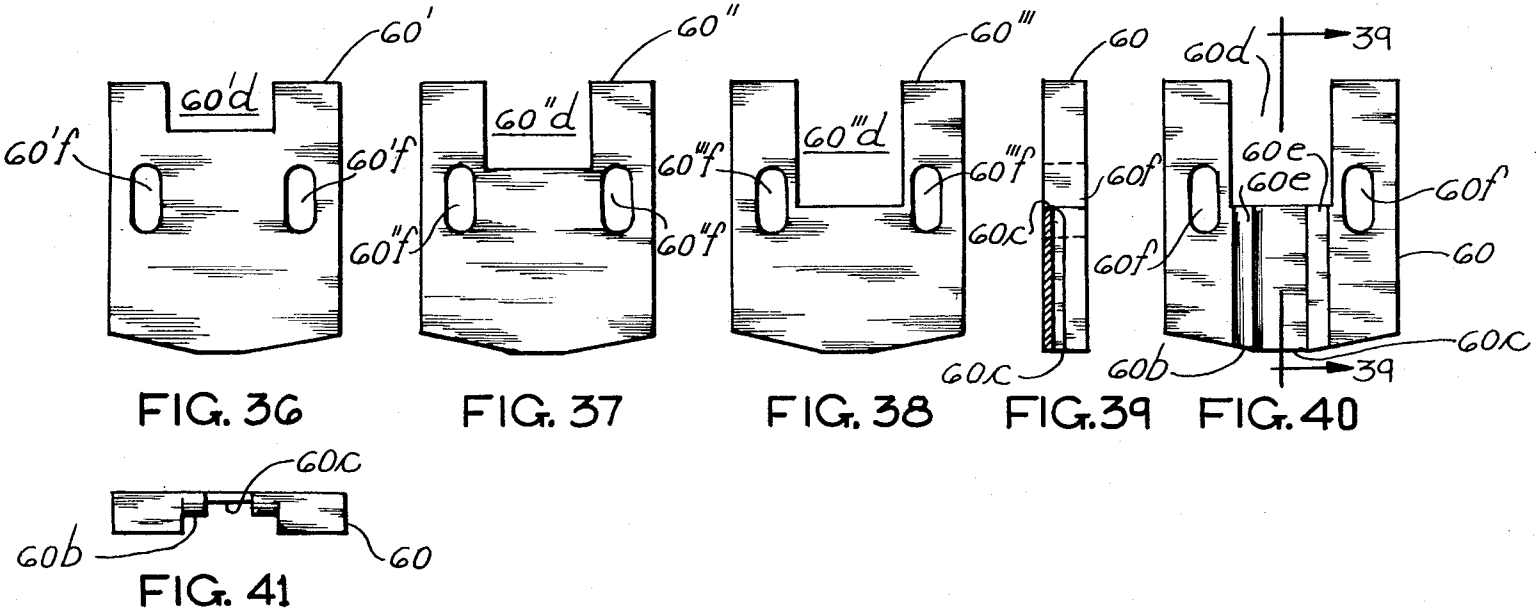
FIG. 36 is a rear view of an embodiment of a movable member of the nail guide and positioning means for use with nails about one inch in length.
FIG. 37 is a rear view of an embodiment of a movable member of said means for use with nails about one a quarter inches in length.
FIG. 38 is a rear view of another embodiment of a movable member of said means for use with about one and a half inch nails.
FIG. 39 is a sectional view taken substantially along line 39—39 of FIG. 40.
FIG. 40 is a front view of the movable member shown in FIG. 38.
FIG. 41 is a top view of the embodiment of the movable member shown in FIG. 36.

As indicated hereinabove, the nailing machine of the present invention can be used with nails of different length. To this end, a plurality of movable members 60 are supplied with the machine 10. Thus, as illustrated in FIGS. 36 through 38, the movable members 60′, 60″, and 60‴ are adapted to accommodate nails one inch, one and a quarter inches, and one and a half inches, respectively, in length. The members 60′, 60″ and 60‴ differ from one another only in the length of the slots 60′*d*, 60″*d*, and 60‴*d* thereof. The slot in each of the members 60′, 60″, and 60‴ cooperate with the slot 58*d* in the member 58, and the slot 14*h* in the foot 14 to provide an opening or gate of the correct dimensions to receive a nail of a selected length. Interchanging of the movable members is easily and readily accomplished by simply turning the knurl-headed screws 70—70 until the movable member can be disengaged from the member 56, and replacing it with a movable member capable of accommodating the length of the nails to be used on a particular job. The frequency of such interchanges is minimal since the same length of nail is generally used on a job throughout the work day.

The feeder mechanism 16 of the embodiment of the nailing machine 10 illustrated is secured, as by screws 72, to the bracket 54 which, in turn, is secured to the foot 14. The feeder mechanism 16, as best shown in FIGS. 4 through 7 comprises an elongated support member 80 desirably fabricated of a lightweight metal such as aluminum or an aluminum alloy. The member 80, as illustrated, has a generally inverted-T configuration, and includes a base portion 80*a* and a centrally positioned upwardly extending rail portion 80*b*. The base 80*a* of the member 80, at its forward end, is secured to the bracket 54 by the screws 72. A generally U-shaped elongated nail guide member 82 is secured as by screws 84 to the base 80*a* of the member 80 rearwardly of its point of connection to the bracket 54. A similarly shaped, elongated nail guide track 86 is secured, as by rivets 88, in overlying relation on the top of the rail portion 80*b* of the support member 80. As best shown in FIG. 1 of the drawing, a pair of screws 90—90 desirably are positioned on the upper surface of the base portion 80*a* forwardly of the midpoint of the member 80. The screws 90—90 serve to anchor one end of a pair of elongated compression springs 92—92 each of which is looped over a pair of pulleys or rollers 94—94 secured to the sides of the bracket 54 by screws 96—96 on opposite sides of the rail portion 80*b* of the member 80. The other end of the springs 92—92 is attached to the rear or tail end of a nail feeder or pusher member 100.

The member 100 as shown is generally U-shaped, and is slidably carried on the nail guide track 86. The sidewalls 100*a*—100*a* of the member 100 have inwardly extending edges 100*b*—100*b* which engage the lower edges of the U-shaped guide track 86 thereby preventing the member 100 from being disengaged from the guide track 86 by the force exerted by the springs 92—92 on the pusher member 100 while at the same time enabling the member 100 to freely slide in either direction on the guide track 86. An upwardly extending stop 102 is provided inwardly of the rear or tail end of the guide track 86 to limit the rearward movement of the pusher member 100.

The leading or ram end 100*c* of the pusher member 100, as shown, is formed as an extension of the sidewalls 100*a*—100*a* of the member 100. The ram 100*c* has a pair of upwardly extending nail-head engaging portions 100*d*—100*d* which are formed with a shoulder 100*e*—100*e* for engaging a small area of the top of the last nail 104*a* of a nailing strip 104. The substantially straight, vertical nail contacting edges 100*d*—100*d* of the ram 100*c* are adapted to engage the head and the upper portion of the shank of the last nail 104*a* comprising the strip 104. This arrangement acts to exert the force transmitted by the springs 92—92 on the pusher member 100 in a manner to always positively urge the nailing strip in a straight, properly aligned path along the guide track 86, and through the slot 14*h* of the foot 14 where each nail is sequentially engaged by the nail guide and positioning means 50. This effect is maintained until every nail, including the last nail 104*a*, has been used. The ability of the ram end 100*c* of the pusher member 100 to keep the nailing strip 104, and each nail comprising the strip, moving in a straight path and in alignment with the gate formed by the slot 14*h* of the foot 14 and the slots 58*d* and 60*d* of the members 58 and 60 eliminates misalignment of a nail with relation to a workpiece while being driven by the blade 36. Thus, not only does the nailing operation proceed without interruption, but, also, there is no wasted effort on the part of the operator and a better work product is obtained. A resilient, nailing strip guide member 110 advantageously is provided to maintain the nailing strip 104 on the guide track 86. As best shown in FIG. 1, one end of the guide member 110 is secured, as by screws 112, to the foot 14, while the free end thereof is curved upwardly and rides along the heads of the nails comprising the nailing strip 104.

The rear end of the pusher member 100 is provided with a pair of spring anchoring extensions 100*f*—100*f*, and a pair of ears or extensions 100*g*—100*g* having bores 100*h*—100*h* for attaching a thong or pull-cord (not shown) to facilitate movement of the pusher member 100 to a fully retracted position on the guide track 86 while a new nailing strip is being inserted on the guide track 86. In order to maintain the pusher member 100 in its fully retracted position during reloading, a detent 100 advantageously is provided on the guide track 86 for engaging a bore in the upper wall of the member 100.

Figure 13:
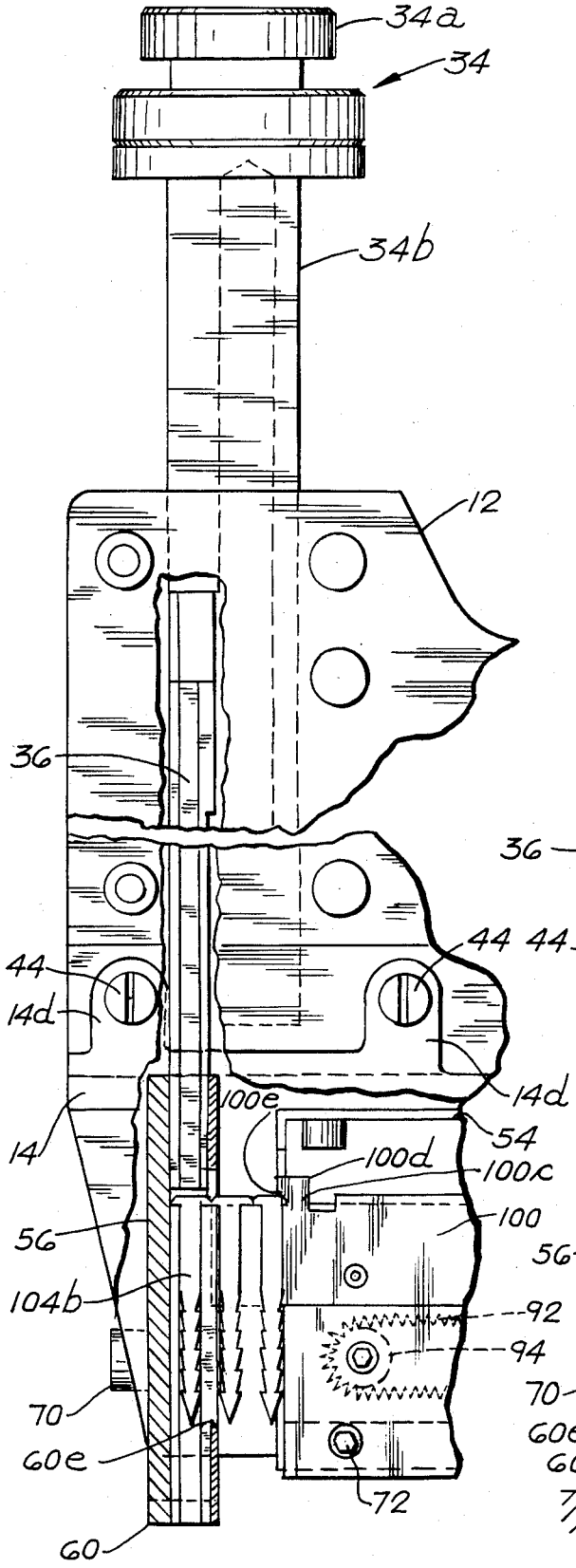
FIG. 13 is an enlarged fragmentary side view, partly in section, of the head end of said embodiment of the invention, showing a nail of a nailing strip in position in the nail guide and positioning means prior to be severed from the nailing strip by the driving blade.
Figure 14:
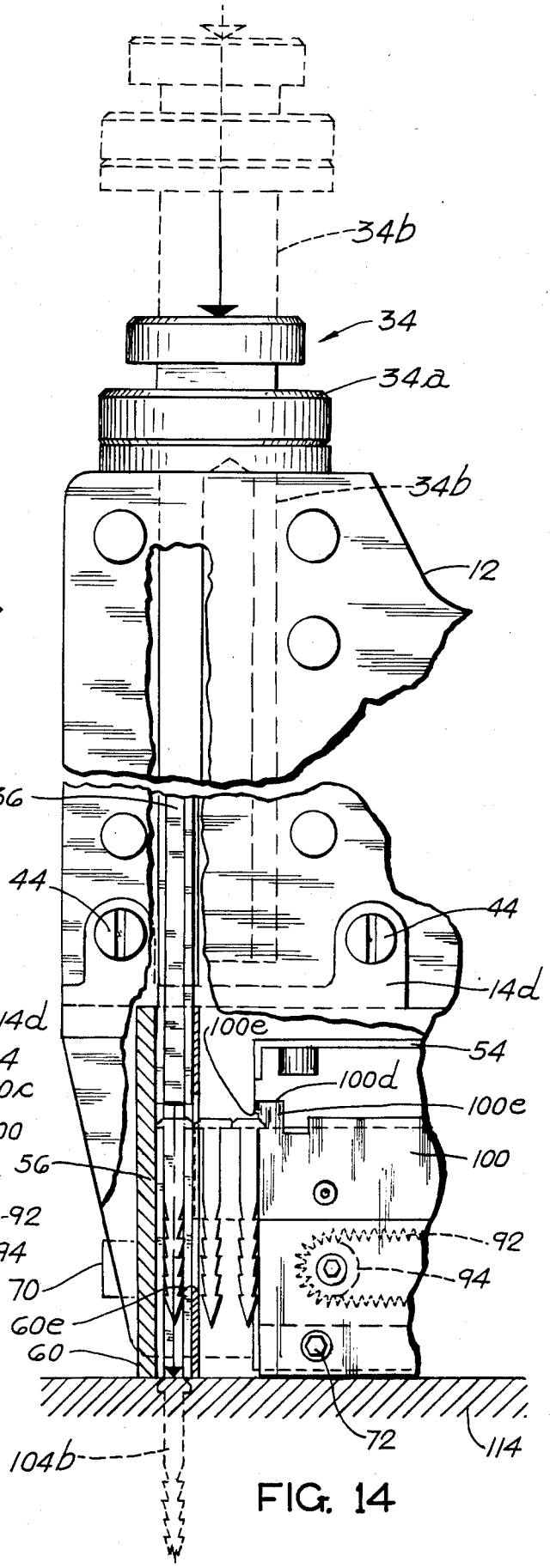
FIG. 14 is a view corresponding to the view of FIG. 13 showing a nail being driven into a workpiece.
Figure 16:
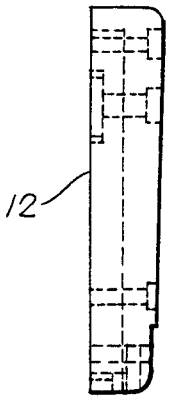
FIG. 16 is an end view of one side of plunger housing shown in FIG. 15.
Figure 15:
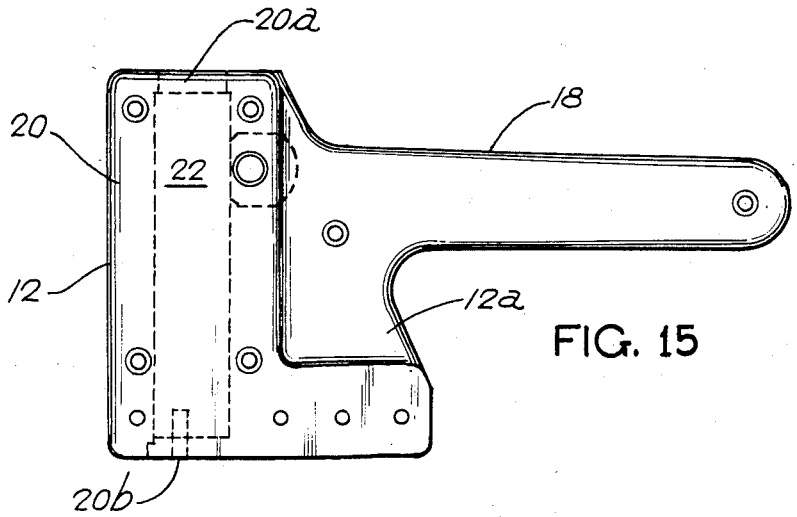
FIG. 15 is a side view in elevation of the plunger housing and handle of said embodiment of the invention.
Figure 17:
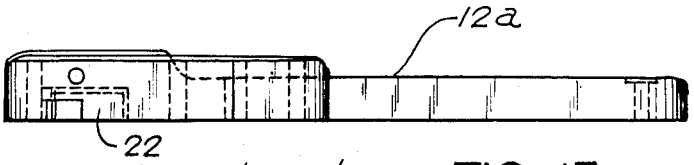
FIG. 17 is a bottom view of one side of the plunger housing shown in FIG. 15.
Figure 18:
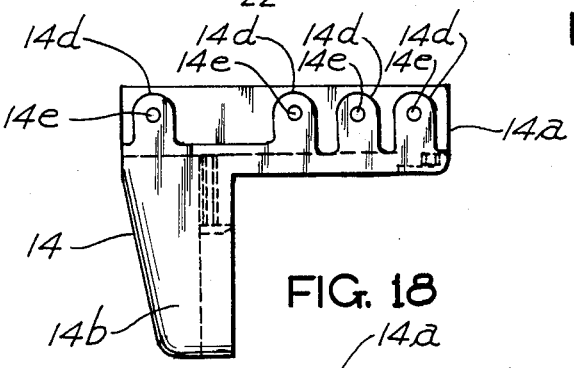
FIG. 18 is a side view in elevation of an embodiment of a foot adapted to be secured to the plunger housing shown in FIG. 15.
Figure 19:
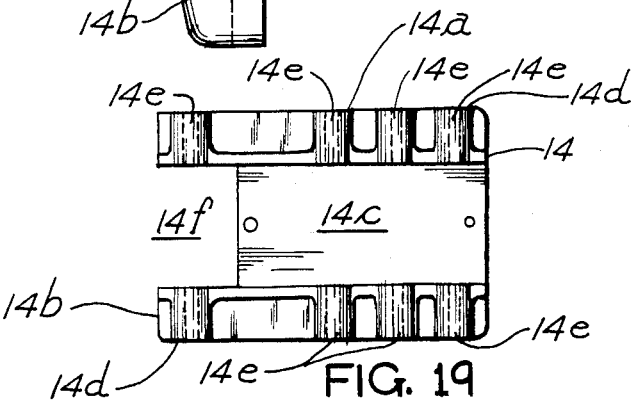
FIG. 19 is a bottom view of the foot shown in FIG. 18.
Figure 20:
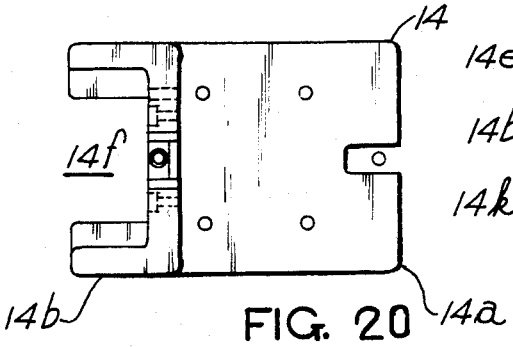
FIG. 20 is a top plan view of the foot shown in FIG. 18.
Figure 21:
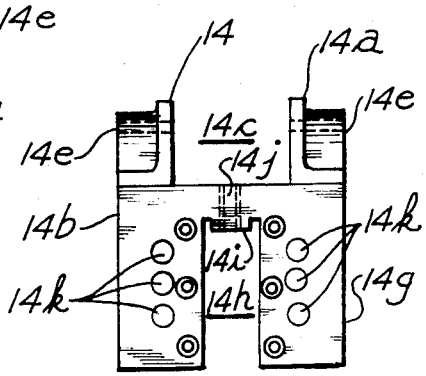
FIG. 21 is a rear end view of the foot shown in FIG. 18 as viewed from the right of FIG. 20.
Figures 22, 23, 24, 25:
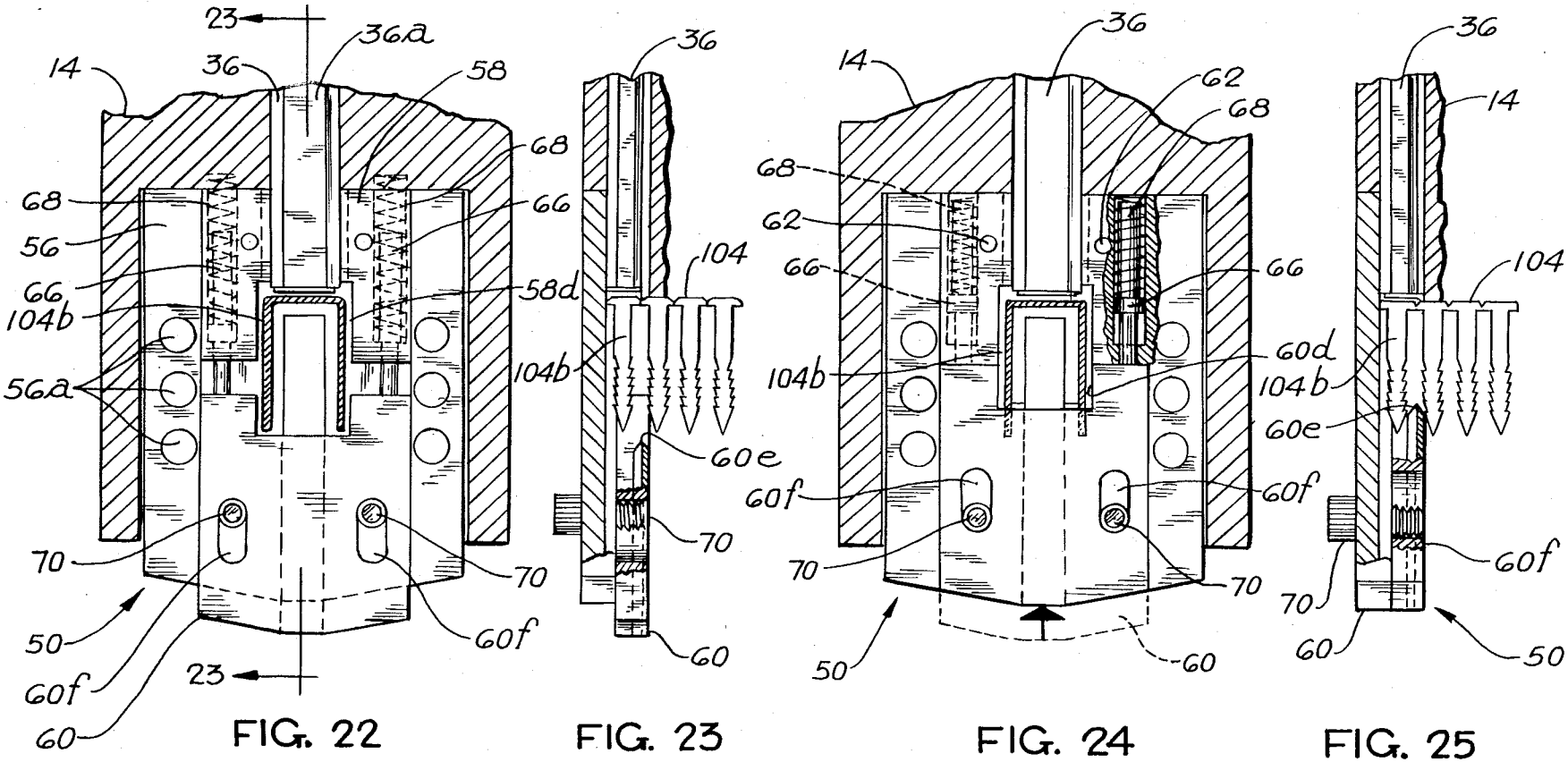
FIG. 22 is a rear view in elevation of the nail guide and positioning means of said embodiment of the nailing machine showing said means in a nail receiving position.
FIG. 23 is a vertical sectional view taken substantially along line 23—23 of FIG. 22.
FIG. 24 is a view corresponding to the view of FIG. 22 showing said means in a nail securing position prior to severing of the nail by the driving blade.
FIG. 25 is a vertical sectional view taken substantially along line 25—25 of FIG. 24.
Figures 26, 27, 28, 29, 30, 31, 32, 33, 34, 35:
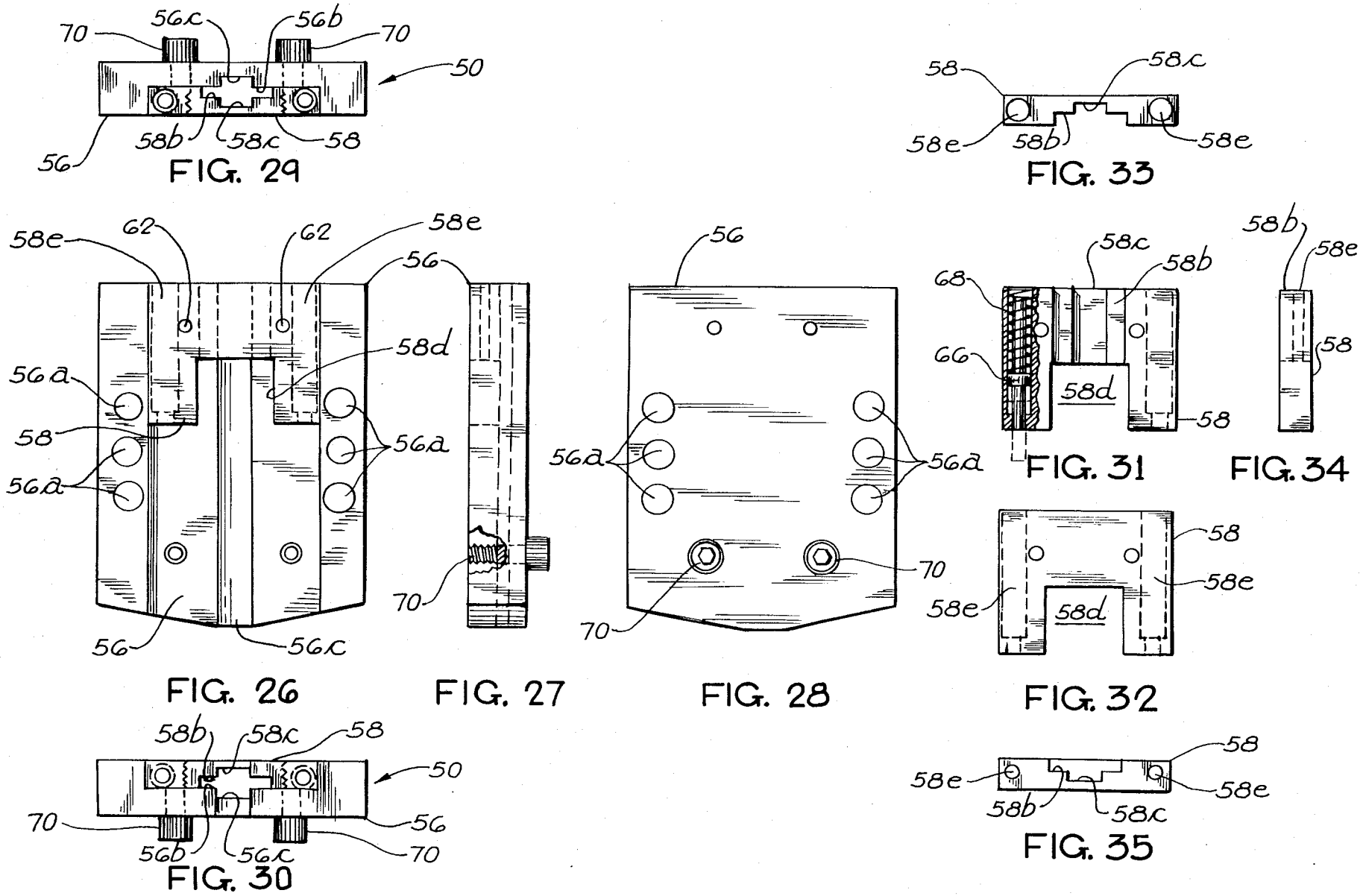
FIG. 26 is a rear view of the stationary driving blade guide plate to which the nail guide and positioning means is attached, with the movable member of said means removed.
FIG. 27 is a side view of the guide plate shown in FIG. 26.
FIG. 28 is a front view of said guide plate.
FIGS. 29 and 30 are top and bottom views, respectively, of said guide plate.
FIG. 31 is a front view of the stationary member of the nail guide and positioning means.
FIG. 32 is a back view of said stationary member.
FIGS. 33, 34 and 35 are top, side and bottom views, respectively, of said stationary member.

In operation, each nail of a nailing strip is automatically sequentially advanced to the nail guide and positioning means 50 by the spring actuated pusher member 100. (See FIGS. 13 and 14.) As a nail, such as nail 104*b*, passes through the gate formed by the slot 14*f* of the foot 14, and the slots 58*d* and 60*d* of the members 58 and 60, the operator places the movable member 60 on a workpiece 114. The member 60 moves upwardly against the bias of the springs 92—92, and the ends of the shanks 104*c* of a nail 104*b* are positively held in the channel 60*b* of the member 60 in alignment with the workpiece 114 and the driving blade 36. The operator then strikes the cap 34*a* of the plunger 34 with a resilient headed maul or mallet which propels the driving blade 36 downwardly thereby severing the nail 104*b* from the strip 104 and driving the nail 104*b* into the workpiece 114. When the operator raises the machine for the next nail driving operation, the movable member 60 is returned to its normally extended position as shown in FIG. 13, and the next nail of the strip 104 is automatically moved into position by the pusher member 100.

While for purposes of illustration, one embodiment of the nailing machine of the present invention has been disclosed, other embodiments may become apparent to those skilled in the art upon reference to this disclosure, and, therefore, the present invention should be limited only by the scope of the appended claims.

What is claimed is:

1. A manually operated nailing machine comprising: a body portion having a handle for enabling an operator to maneuver the machine into a nailing position; reciprocatable plunger means including a nail driving blade positioned in said body portion; a stationary foot secured to the body portion, said foot having a nail gateway formed therein; nail feeder means secured to the foot, said nail feeder means including a strip of interconnected nails adapted to be sequentially advanced one at a time through the nail gateway of the foot into a position to enable each nail of the strip to be driven into a workpiece by the nail driving blade; and nail guide and positioning means for sequentially receiving a single nail from the nail feeder means as it is passed through the nail gateway of the foot, said nail guide and positioning means including an outer stationary driving blade guide member secured to said foot, an inner stationary driving blade guide member secured to the outer stationary driving blade guide member, and a movable driving blade guide member slidably supported on the outer stationary driving blade guide member in alignment with the inner stationary driving blade guide member and being movable between a normally extended nail receiving position and a nail contacting and aligning position, said outer and inner stationary driving blade guide members, and said movable driving blade guide member together forming a driving blade guideway therebetween, said inner stationary driving blade guide member and said movable driving blade guide member being provided with slots which together form a nail gateway having dimensions substantially equal to the dimensions of the nail gateway of the foot when the movable driving blade guide member is in its normally extended nail receiving position, said nail gateway formed by said slots having dimensions substantially smaller than the nail gateway of the foot when the movable driving blade guide member is in a nail contacting and aligning position for maintaining a single nail in proper position in said driving blade guideway when the machine is in a nail driving position and a nail is to be driven into a workpiece.

2. A nailing machine according to claim 1, wherein the inner stationary driving blade guide member is provided with biasing means for maintaining the movable driving blade guide member in a normally extended position.

3. A nailing machine according to claim 1 wherein the the outer and inner stationary driving blade guide members and the movable driving blade guide member are each provided with a channel and a recess which substantially conform in cross-section to the cross-section of the nail driving blade, and which together provide a continuous passageway along which the nail driving blade travels when driving a nail into a workpiece.

4. A nailing machine according to claim 3 wherein the upper edges of the channel of the movable driving blade guide member are beveled to facilitate contact of the movable driving blade guide member with the shanks of a nail when the nailing machine is placed in a nail driving position.

5. A nailing machine according to claim 1 wherein the nail feeder means comprises an elongated nail track for supporting a nailing strip; and nail pusher means slidably engaged on the nail track, said nail pusher means having a ram portion provided with substantially straight, vertical nail contacting edges adapted to abut a portion only of the shanks of the last nail comprising the nailing strip, said ram portion further being provided with upwardly extending nail-head engaging portions adapted to overlie a small area of the top of said last nail.

6. A nailing machine according to claim 5 wherein spring means is provided for the nail feeder means, one end of the spring means being attached to the nail pusher means and the other end thereof being anchored to the nail feeder means.

7. A nailing machine according to claim 6 wherein the nail feeder means is secured to a bracket, said bracket, in turn, being secured to the foot of the nailing machine, and a pair of rollers is secured to the bracket for supporting the spring means forwardly of the nail pusher means.

8. A nailing machine according to claim 5 wherein detent means is provided on the nail track for maintaining the nail pusher means in a stationary position on the nail track during reloading of the nail feeder means with a nailing strip.

9. A nailing machine according to claim 5 wherein the nail pusher means is provided with a pair of integral laterally extending, finger gripping ears to enable an operator to move the nail pusher means to a retracted position on the nail track during reloading.

10. A nailing machine according to claim 1 wherein the movable driving blade guide member is provided with a pair of close-ended slots for receiving releasable pin means carried on the outer stationary driving blade guide member, said close-ended slots and pin means serving to limit the movement of the movable driving blade guide member in relation to the inner stationary driving blade guide member.

* * * * *